US005395748A

United States Patent [19]

Adin et al.

[11] Patent Number: 5,395,748

[45] Date of Patent: Mar. 7, 1995

[54] BALLASTED OPTICAL BRIGHTENERS

[75] Inventors: Anthony Adin, Rochester; Pranab Bagchi, Webster, both of N.Y.

[73] Assignee: Eastman Kodak Company, Rochester, N.Y.

[21] Appl. No.: 164,091

[22] Filed: Dec. 8, 1993

[51] Int. Cl.[6] ..... G03C 1/815

[52] U.S. Cl. ..... 430/512; 430/539; 430/518; 430/504; 430/139; 430/933; 430/628; 252/301.21; 252/301.23; 252/301.25; 530/354

[58] Field of Search ..... 430/512, 539, 518, 504, 430/139, 933, 628; 252/301.21, 301.23, 301.25; 530/354

[56] References Cited

U.S. PATENT DOCUMENTS

| | | | |
|---|---|---|---|
| 3,181,949 | 5/1965 | Koerber et al. | 430/139 |
| 3,462,388 | 8/1969 | Horiguchi et al. | 8/647 |
| 3,580,720 | 5/1971 | Ohyama et al. | 430/139 |
| 3,666,680 | 5/1972 | Briggs | 252/301.21 |
| 3,677,762 | 7/1972 | Amano et al. | 430/504 |
| 3,749,707 | 7/1973 | Vrancken | 530/354 |
| 4,072,624 | 2/1978 | Croome et al. | 252/301.25 |
| 4,115,124 | 9/1978 | Hamilton | 430/518 |
| 4,203,716 | 5/1980 | Chen | 430/207 |
| 4,302,579 | 11/1981 | Evans | 544/193.2 |
| 4,526,853 | 7/1985 | Nishijima et al. | 430/139 |
| 4,855,219 | 8/1989 | Bagchi et al. | 430/496 |
| 4,920,004 | 4/1990 | Bagchi | 428/407 |
| 4,943,519 | 7/1990 | Helling et al. | 430/512 |
| 5,026,632 | 7/1991 | Bagchi et al. | 430/545 |
| 5,055,379 | 10/1991 | Bagchi et al. | 430/289 |
| 5,066,572 | 11/1991 | O'Connor et al. | 430/503 |

FOREIGN PATENT DOCUMENTS

| | | | |
|---|---|---|---|
| 0062029 | 3/1991 | Japan | 430/933 |

OTHER PUBLICATIONS

Research Disclosure, Dec. 1989, *Photographic Silver Halide Emulsions, Preparations, Addenda, Processing and Systems*, pp. 993–1015.

*Primary Examiner*—Thomas R. Neville

*Attorney, Agent, or Firm*—Andrew J. Anderson

[57] ABSTRACT

An inexpensive, ballasted optical brightener for use in photographic elements is prepared by reacting an optical brightener of the formula where M is a cation; X is a group capable of undergoing nucleophilic displacement; and Z is or —O—$R_3$, where each of R1 and R2 is a hydrogen atom, or an aromatic group which can be unsubstituted or substituted with one or more groups unreactive towards X; and R3 is an aromatic group which can be unsubstituted or substituted with one or more groups unreactive towards X with a water soluble polymer, such as gelatin. The resulting ballasted optical brightener is stable in aqueous photographic compositions.

4 Claims, 2 Drawing Sheets

BALLASTED OPTICAL BRIGHTENERS

FIELD OF THE INVENTION

This invention relates to a ballasted optical brightener, a photographic element comprising said ballasted optical brightener and to a method of preparing said ballasted optical brightener.

BACKGROUND OF THE INVENTION

Optical brighteners are added to certain photographic elements, for example graphic arts black and white photographic paper, to produce a white appearing background. Photographically useful optical brighteners can be oil-soluble or water-soluble compounds. Oil-soluble optical brighteners can be utilized in aqueous photographic compositions as dispersions in oil or in a polymer latex, see for example, U.S. Pat. No. 4,230,716 to Chen. But such oil-soluble brighteners are very expensive and are not usually used as they substantially increase the cost of the product. Further, oil-soluble optical brighteners tend to self quench (i.e. lose some of their fluorescence) unless the oil phase of the dispersion is very dilute, which is generally undesirable as it increases the solvent load in the photographic element. Also, oil dispersed optical brighteners tend to retain sensitizing dyes which can cause stain in the photographic element.

Water-soluble optical brighteners are a constituent of common laundry detergent and consequently are available at relatively low cost. Because of their water-solubility, such compounds can be added directly into an aqueous photographic coating composition and do not need to be dispersed as an oil phase, thereby providing additional cost savings in the manufacture of the photographic element. However, such water-soluble optical brighteners tend to diffuse out of the photographic element or from one layer of the photographic element to another during coating and processing of the element, thereby reducing the effectiveness and specificity of the brightener. For this reason, most photographically useful optical brighteners, are ballasted. Most ballasted optical brighteners are expensive compared to the unballasted versions.

Usually, some of the water-soluble optical brightener is washed out during processing of the film and the retained optical brightener performs the required brightening. With low cost water-soluble brighteners, even with the wash loss, photographic elements containing the optical brightener are reasonably priced. However, the leached out brightener continuously seasons the developer solution, requiring it to be replenished more frequently to ensure the uniformity of the processed product.

Therefore, there exists a need to provide inexpensive, water-soluble optical brighteners for photographic coatings which do not diffuse from one layer to another nor leach into the processing solution.

Two approaches reported in the art to resolve this problem are described in U.S. Pat. Nos. 3,677,762 to Amano et al and 3,749,707 to Hove et al. In U.S. Pat. No. 3,677,762, a high molecular weight polymeric optical brightener is described. The cost of manufacturing such specialized functional polymers is generally even more expensive than the use of oil-soluble optical brighteners. Also, polymeric optical brighteners tend to undergo self quenching of fluorescence as the optical brightener moieties come close together in an oily polymer composition. U.S. Pat. No. 4,943,519 describes compositions of such polymeric optical brighteners or latex polymeric optical brighteners. In U.S. Pat. No. 3,749,707, the optical brightener is reacted with gelatin to reduce the water solubility of the compound. In example 3 of the '707 patent, the optical brightener, 2,2'-disulfo-4,4'(2,4-dichloro-s-triazine-6-yl-amino)-stilbene, is reacted with gelatin. It is reported that the gelatin derivative prepared became water insoluble after storing. This is due to crosslinking of the gelatin and can limit the shelf life and utility of the brightener/gelatin combination.

PROBLEM TO BE SOLVED BY THE INVENTION

Therefore, there exists a need to provide inexpensive, ballasted, water-soluble optical brighteners in photographic coatings in an inexpensive manner and to provide a storage stable optical brightener, that are less prone to being washed out during processing.

SUMMARY OF THE INVENTION

One aspect of this invention comprises a ballasted optical brightener of the formula:

Compound (I)

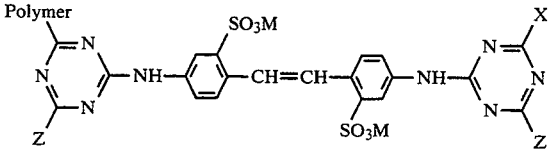

wherein Polymer is a water-soluble polymer; M is a cation; X is a group capable of undergoing nucleophilic displacement; and Z is

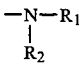

or —O—$R_3$, where each of $R_1$ and $R_2$ is a hydrogen atom, or an aromatic group which can be unsubstituted or substituted with one or more groups unreactive towards X; and R3 is an aromatic group which can be unsubstituted or substituted with one or more groups unreactive towards X.

Another aspect of this invention is a photographic element comprising in at least one layer thereof, a ballasted optical brightener as defined above.

A further aspect of this invention is a method for preparing a ballasted optical brightener comprising reacting a water-soluble polymer with an optical brightener of the formula:

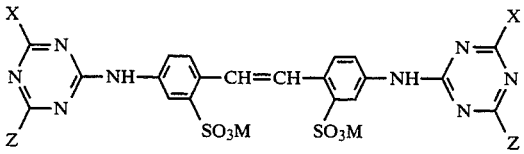

M is a cation; X is a group capable of undergoing nucleophilic displacement; and Z is

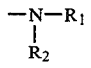

or —O—$R_3$, where each of $R_1$ and $R_2$ is a hydrogen atom, or an aromatic group which can be unsubstituted or substituted with one or more groups unreactive towards X; and R3 is an aromatic group which can be unsubstituted or substituted with one or more groups unreactive towards X. The reaction preferably takes place in an aqueous medium in the presence of a base.

ADVANTAGEOUS EFFECTS OF THE INVENTION

Figure 1:
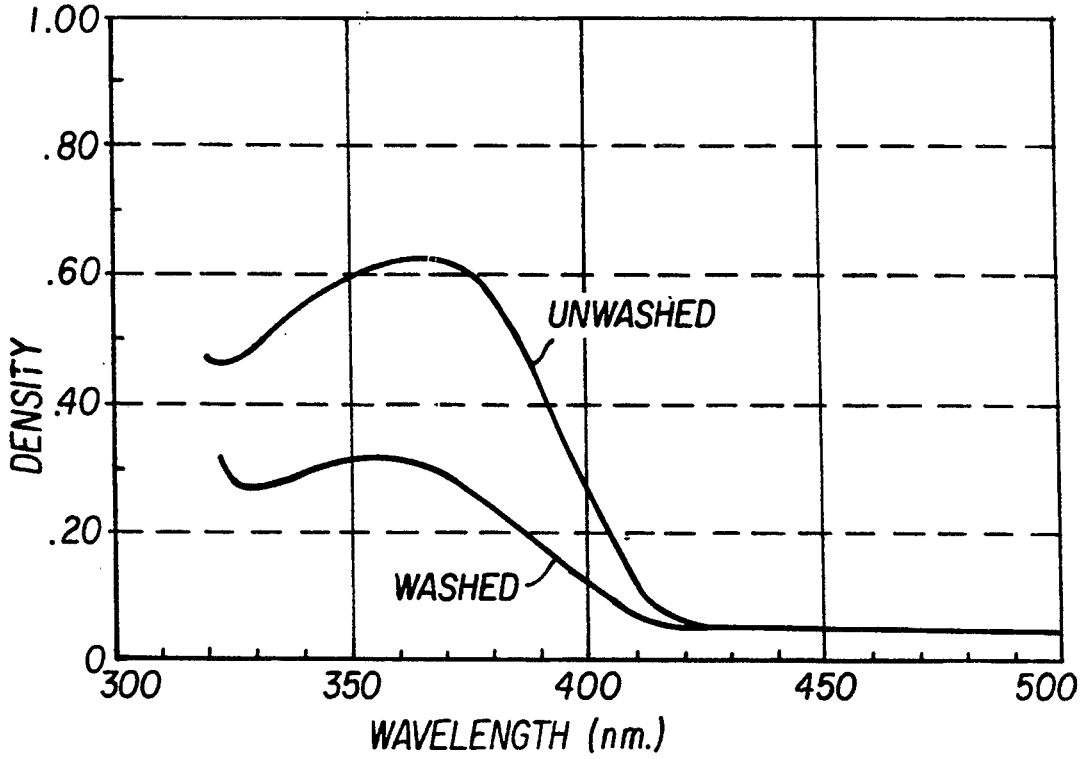
FIGS. 1 and 2 represent the UV and visible spectra of elements each comprising a support having thereon a coating of an aqueous gelatin composition containing a ballasted optical brightener in accordance with this invention, as set forth below in Examples 3 and 4, respectively.

Ballasted optical brighteners of this invention:

(i) are not washed out of the coatings during processing leading to increased efficacy and hence achieve significant cost savings;

(ii) can be manufactured using gelatin (which is commercially available and inexpensive) as the ballast and because they are water-soluble, they do not need to be dispersed as a an oil phase in aqueous photographic coating compositions, thereby further reducing the cost of manufacture of the photographic element;

(iii) have higher brightening efficiency compared to oil dispersed, latex soluble or polymeric brighteners, which are all subject to self quenching as they form compact particles;

(iv) generally do not retain sensitizing dyes (unlike oil dispersed, latex dispersed or polymeric optical brighteners) which can cause undesired stain in the resulting photographic element; and (v) are storage stable without crosslinking.

Further, the preferred optical brightener, compound (I) below, is a high extinction absorber for UV-radiation and, as such, the ballasted material can be utilized in appropriately positioned UV-protection layers.

DETAILED DESCRIPTION OF THE INVENTION

The ballasted optical brightener of this invention can be prepared by reacting a) an optical brightener of the formula:

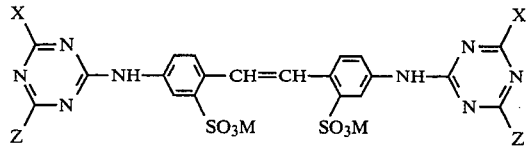

wherein M is a cation, for example an alkali metal ion such as sodium or potassium, an ammonium ion, or the like; X is a group capable of undergoing nucleophilic displacement, for example a halogen atom, trihalomethyl group and the like; and Z is

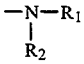

or —O—$R_3$, where each of $R_1$ and $R_2$ is a hydrogen atom, or an aromatic group which can be unsubstituted or substituted with one or more groups unreactive towards X, for example, halogen, alkoxy, dialkyl amino, etc. with b) a water-soluble polymer with a pendant functionality capable of bonding with the optical brightener. Such functionalities are preferably pendant primary or secondary amino, phenolic or naphtholic functions, etc.

The optical brightener starting material can be prepared known by processes, such as that described in U.S. Pat. No. 4,302,579, the disclosure of which is incorporated herein by reference.

The water-soluble polymer is preferably gelatin, aminoethylacrylate/co methylacrylate/co 3-sufopropylacrylate, sodium salt; 4-aminostyrene/co styrene/co styrene-4-sulfonic acid, sodium salt and similar water soluble copolymers. A preferred water-soluble polymer is gelatin.

Photographic gelatin is usually lime processed ossein gelatin as extensively described in "The Theory of the Photographic Process," T. H. James Ed., Macmillan, New York, N.Y. (1977), page 51–87, Chapter - II. Other types of gelatins that are sometimes used in photographic systems are, acid processed hide and bone gelatins, and various demineralized gelatins that have been reacted with small molecules, oligomeric molecules, water-soluble polymeric molecules or polymer particles. A description of such gelatins may be found in U.S. Pat. Nos. 5,066,572, 5,026,632 and 5,055,379 of Bagchi, which are incorporated herein by reference.

The reaction between the optical brightener and the water soluble polymer preferably takes place in an aqueous medium in the presence of an acid receptor, such as a base. The base can be for example, a simple alkali. The amount of base present should adjust the pH of the medium to at least about 7.5, preferably about 8.0 to about 9.0. The temperature at which the reaction takes place is preferably at least about 65° C., more preferably about 70° to about 75° C. The concentration of the gelatin in the aqueous medium is preferably above about 5% by weight, based on the weight of the gelatin and water. In preferred embodiments of the invention the concentration of the gelatin is between about 5 and about 20 % by weight. The amount of optical brightener is preferably at least about 3% by weight, based on the weight-of the gelatin. The amount of optical brightener that should be used depends of the concentration of the gelatin. In general, the amount of optical brightener relative to the amount of gelatin is the area to the right of the line A-B in FIG. 4, as described in more detail below.

The chemical bonding of the optical brightener, which is at least partially water soluble to gelatin ( or other water soluble polymer) produces a nondiffusible gelatin-ballasted material that can be used in photographic coatings. Further, the gelatin ballasted optical brightener is storage stable without crosslinking. The preferred embodiment of the invention involves the direct attachment of the optical brightener via an active halogen atom to pendant amine groups in gelatin. This reaction is driven by an acid receptor, such as a simple alkali, as acid is released in the reaction. The following represents this reaction:

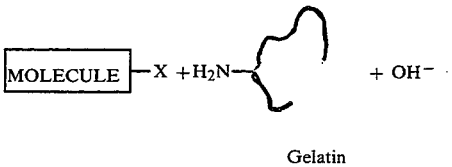

Heat

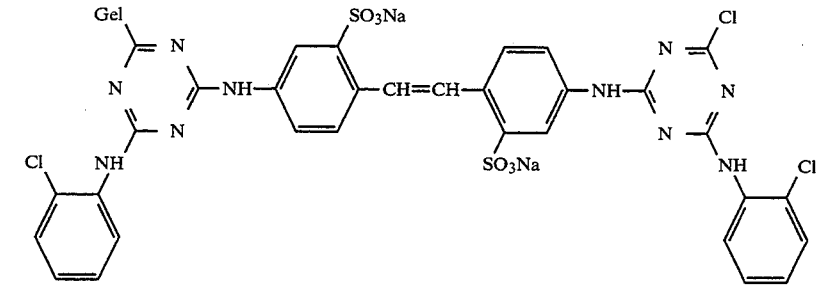

Compound (I)

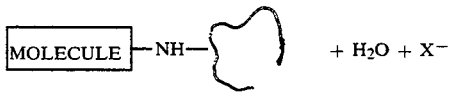

As set forth above, the ballasted optical brightener of this invention has the formula:

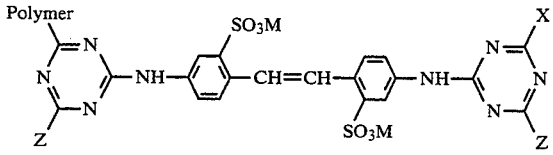

wherein Polymer is a water-soluble polymer and M, and X is a group capable of undergoing nucleophilic displacement, for example a halogen atom, trifluoromethyl group, etc.; and Z is

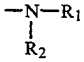

—O—$R_3$, where each of $R_1$ and $R_2$ is a hydrogen atom, or an aromatic group which can be unsubstituted or substituted with one or more aliphatic groups unreactive towards X, for example, halogen, alkoxy, dialkyl amino, etc.

A preferred ballasted optical brightener of this invention is Compound (I) having the formula:

where Gel is a gelatin residue.

Compound (I) is prepared by reacting gelatin with the sparingly water-soluble bis-chlorotriazinylaminostilbene optical brightener having the formula

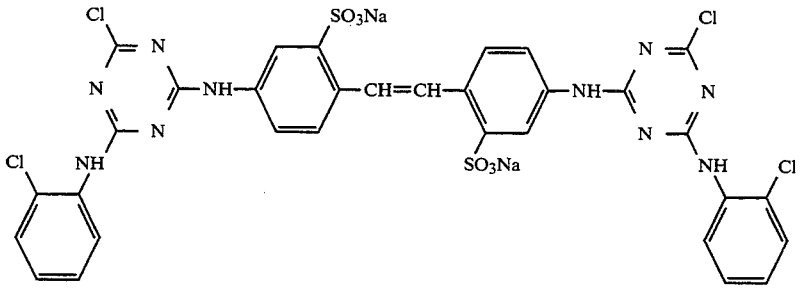

This compound has a molecular weight of 892, absorption maximum of 351 nm in methanol and an extinction coefficient of 52,000. The chlorine atom on the triazine ring is the active halogen that partakes in the reaction with the pendant amines in gelatin. There are two active halogen atoms in this molecule, only one of which is replaced with Gel.

Gelatin has, in general, two types of pendant functionalities that can be utilized to effect chemical bonding. These are primary and secondary amines and carboxyl groups. U.S. Pat. Nos. 4,855,219 to Bagchi et al and 4,920,004 to Bagchi describe the chemical immobilization of gelatin on the surface of polymer particles.

The immobilization is achieved via direct linking to the pendant functionalities as described in above mentioned U.S. Pat. Nos. 4,855,219, and 4,920,004, and U.S. Pat. No. 5,026,632 to Bagchi et al. U.S. Pat. No. 5,026,632 discloses a detailed description of chemical reactions that can be utilized to graft on to a gelatin molecule. One of the most convenient methods of direct attachment is the reaction of an active halogen atom to pendent amine groups in gelatin or a water-soluble gelatin compatible synthetic polymer with a pendant functionality capable of bonding with the optical brightener. Such functionalities include primary amines, secondary amines, phenols, naphthols, etc.

The photographic element of this invention comprises in at least one layer thereof a ballasted optical brightener of this invention. The photographic element is prepared by coating one or more layers onto a support, at least one of the layers comprising a photosensitive material, such as a silver halide emulsion, and at least one of the layers containing a ballasted optical brightener of this invention. The ballasted optical brightener of this invention is preferably in an emulsion layer, an overcoat layer or in the layer closest to the support, i.e. the layer generally referred to as the subbing layer. The support is preferably a paper support as described in Section XVII paragraph B of *Research Disclosure* 308119 of December 1989, published by Kenneth Mason Publications, Ltd., Dudley Annex, 12a North Street, Emsworth, Hampshire P010 7DQ, England.

The ballasted optical brightener is added to an aqueous photographic coating composition comprising gelatin and optionally one or more photographically useful compounds. Because the ballasted optical brightener is ballasted with a water-soluble polymer it is compatible with water of the aqueous coating composition and can be added directly to the composition.

The photosensitive layer preferably comprises a silver halide emulsion such as those described in Section I of the above noted *Research Disclosure.* The layers are coated on the support by coating methods such as those described in Section XV of the *Research Disclosure.* The support of photographic elements of this invention can be coated with a magnetic recording layer as discussed in Research Disclosure 34390 of November 1992, the disclosure of which is incorporated herein by reference The following examples illustrate the practice of this invention.

In the examples it is shown that when gelatin ballasted optical brightener is coated in a gelatin layer, considerably larger amounts of the brightener remains immobilized in the emulsion layer, compared to a comparable layer in which an unballasted optical brightener is simply added from a methanol solution to the coating melt.

EXAMPLES 1 AND 2

Two inventive samples of gelatin-grafted optical brightener were prepared. Sample of Example-I was prepared with no added base as acid receptor and the sample of Example 2 was prepared with adjustment of the gelatin pH to 8.0 with 20% NaOH solution to provide a controlled acid receptor.

EXAMPLE 1

To 100 g of a 10% type IV gelatin at pH of 6.5 was added 2 g of optical brightener of the formula

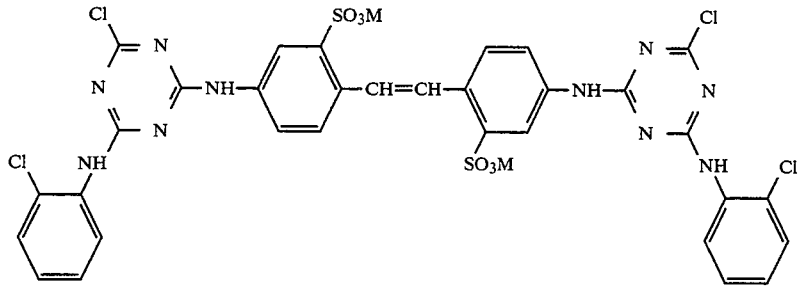

The sample was heated with stirring at 70° C. for 2 hours. The amount of brightener compound was more than that needed to bind with all the pendant amine groups in the amount of gelatin used. The resultant gelatin melt was dialyzed continuously against distilled water at 45° C. for 18 hours to remove as much of the unbound brightener as possible. The resulting melt had a solids content of 4.5%. From an UV spectrum of the sample, the brightener content was determined to be 1.0%.

EXAMPLE 2

To 100 g of a 10% type IV gelatin at pH of 8.0 was added 2 g of the same optical brightener compound used in Example 1. The sample was heated with stirring at 70° C. for 2 hrs. The amount of brightener compound was more than that needed to bind with all the pendant amine groups in the amount of gelatin used. The resultant gelatin melt was dialyzed continuously against distilled water at 45° C. for 18 hrs to remove as much of the unbound brightener as possible. The resulting melt had a solids content of 3.9%. From an UV spectrum of the sample, the brightener content was determined to be 1.1%. Therefore the gelatin content of the sample was estimated to be 2.8%.

EXAMPLES 3,4 AND 5

Coating and Evaluation of Gelatin-Grafted Optical Brightener Materials

Samples of Examples 1 and 2 were mixed with additional Type-IV gelatin and coated on a clear photographic support using a standard coating machine to produce aim laydowns of 36 mg per sq ft of the ballasted optical brightener, and 320 mg per sq ft of gelatin. All coatings were overcoated with a layer containing 80 mg per sq ft of gelatin. The overcoat layer was doctored with the gelatin hardener bis(vinylsulfonylmethane) at rate of 2% based upon the total gelatin in the sample.

A control coating was also prepared containing 36 mg per sq ft of the unballasted optical brightener used in Examples 1 and 2, added directly to the coating gelatin melt as a 20 mg per ml solution in methanol/water (80/20). It was assumed that the brightener compound would undergo negligible grafting to the coating gelatin under these conditions. The coating Examples were identified as follows.

COATING EXAMPLE 3: prepared with the pH 6.5 grafted material of Example 1.

COATING EXAMPLE 4: prepared with the pH 8.0 grafted material of Example 2.

COATING EXAMPLE 5: control coating as described above.

Figure 2:
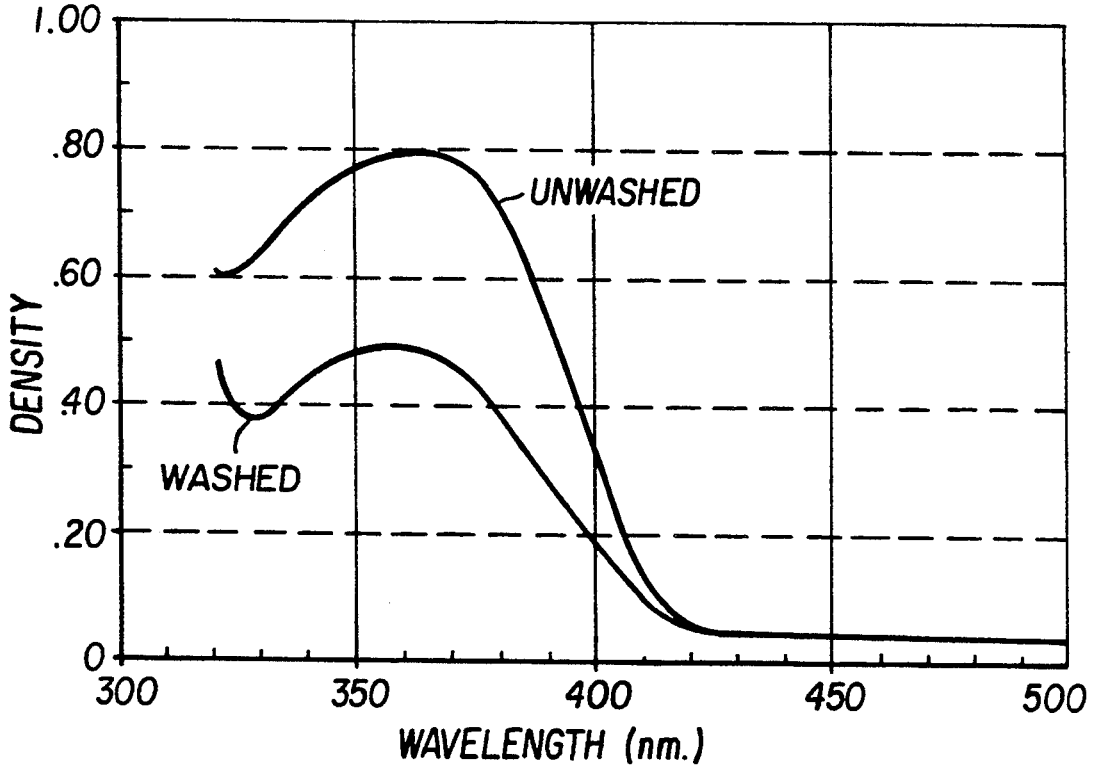
Figure 3:
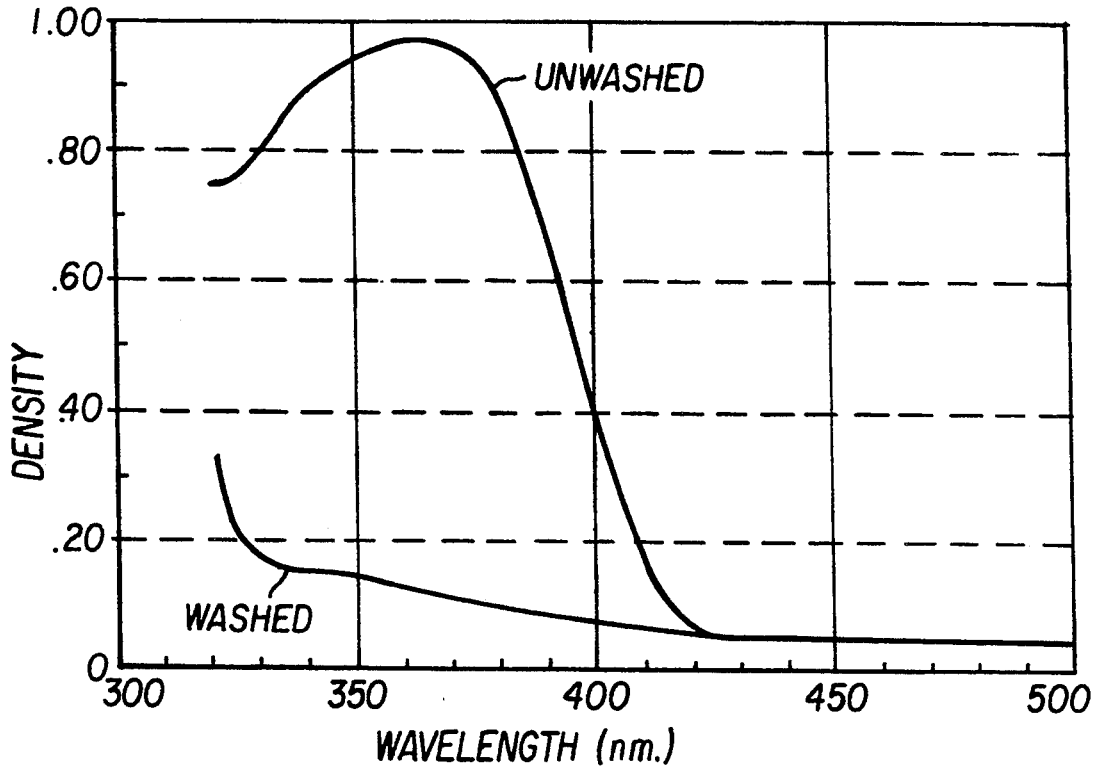
FIG. 3 represents the UV and visible spectra of a control element which comprises a support having thereon a coating of an aqueous gelatin composition containing an unballasted optical brightener as set forth below in Example 5.

The UV and visible spectra of the coating Examples 3, 4, and 5 are shown in FIGS. 1, 2, and 3, respectively, marked as the unwashed coatings. The differences in the absorption maximum at around 360 nm for the three different coatings, show greater variability than expected from coating variability. This may be associated with the use of the extinction coefficient in methanol to compute the final concentration of the brightener in the dialyzed gelatin-grafted-brightener samples. However, this variability does not interfere with the demonstration of the invention.

To demonstrate chemical attachment of the brightener to gelatin, about 100 sq cm of all the three coatings were thoroughly washed in three successive 100 ml portions of methanol/water (80/20). This solvent is capable of dissolving 20 mg the optical brightener per ml of the solvent. Therefore, very large excess of the solvent was actually used to extract the brightener from the coatings. The washed coatings were dried and the brightener contents were determined by obtaining the UV-VIS spectra of these coatings. The spectra of the washed coatings of Examples 3, 4, and 5 are also shown in FIGS. 1, 2, and 3 respectively. In the results of the control coatings of FIG. 3, it is seen that the density loss at the peak maximum due to the aqueous methanol wash was 90.5%, indicating that majority of the coated brightener was washed out, as not being chemically bound. In the case of the inventive coating of Example 3 (FIG. 1), where the grafting reaction was carried out with heat but with no added acid receptor, similar brightener loss was only 54% of the initial unwashed amount, indicating considerable amount of chemical binding of the brightener to gelatin. In the case of the second inventive coating of Example 4, where both heat and an acid receptor was used to prepare the gelatin-grafted-brightener sample, it is noted in FIG. 2, that the brightener loss is further reduced to 40% of the original amount. This observation is tabulated in Table I.

TABLE I

WASH OUT OF OPTICAL BRIGHTENER FROM COATING EXAMPLES

| Coating | Prepared with | Reaction Condition | % Brightener Lost with Methanol/Water (80/20) wash |
|---|---|---|---|
| Example-3 Inventive | Gel-grafted-Brightener of Example 1 | Heat Only | 54.0 |
| Example-4 Inventive | Gel-grafted-Brightener of Example 2 | Heat + Base | 40.0 |
| Example-5 Control | Added Brightener | No Treatment | 90.5 |

EXAMPLES 6 -17

Determination of Effective Crosslink-Free Domain of Optical Brightener Grafting Twelve gelatin bonded optical brightener compound samples were prepared using several gelatin concentrations and several ratios of gelatin to optical brightener in much the same manner as those in Example 2. The compositions of these preparations are shown in Table II. Some of the samples underwent crosslinking such that they were insoluble due to the presence of two active halogen atoms on the optical brightener molecule. Some had somewhat enhanced viscosities but were coatable. Some of the coatable samples were coated in the same format described in Examples 3, 5, and 10 and the extent of optical brightness retention was measured using a methanol water wash. These numbers are also listed in Table II.

TABLE II

Preparations and Characteristics of Gel-grafted-Optical Brightener Sample

| Example | Gelatin Concentration Used | Vol. of Gelatin Solution (ml) | Wt. of Dry Gelatin (g) | Wt. of Optical Brightener (g) | Optical Brightener as % of gel | Cross-Link | % of Optical Brightener Retained |
|---|---|---|---|---|---|---|---|
| 6 | 5% | 400 | 20 | 1 | 5% | yes | — |
| 7 | 5% | 400 | 20 | 2 | 10% | no | — |
| 8 | 5% | 400 | 20 | 3 | 15% | no | — |
| 9 | 5% | 400 | 20 | 4 | 20% | no | — |
| 10 | 10% | 100 | 10 | 0.5 | 5% | yes | 50% |
| 11 | 10% | 100 | 10 | 1.0 | 10% | yes | — |
| 12 | 10% | 100 | 10 | 1.5 | 15% | no (viscous) | 73% |
| 13 | 10% | 100 | 10 | 2.0 | 20% | no | 60% |
| 14 | 20% | 100 | 20 | 1.0 | 5% | yes | — |
| 15 | 20% | 100 | 20 | 2.0 | 10% | yes | — |
| 16 | 20% | 100 | 20 | 3.0 | 15% | yes | — |
| 17 | 20% | 100 | 20 | 4.0 | 20% | no (viscous) | 50% |

Figure 4:
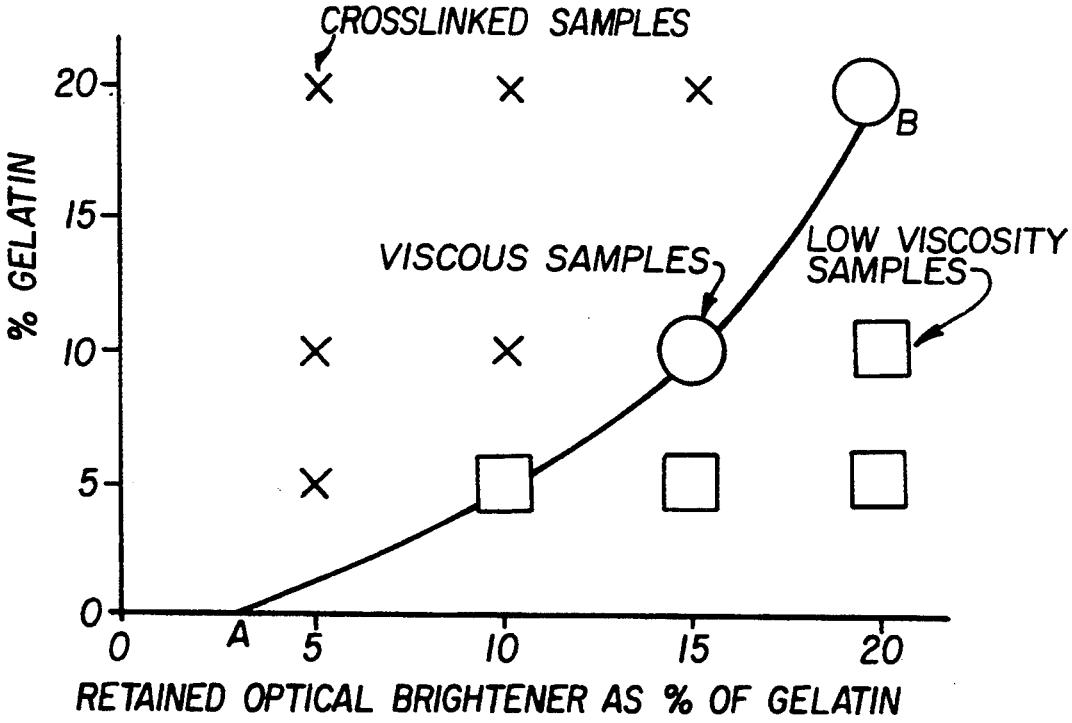
FIG. 4 represents is a graph showing the characteristics of gelatin-grafted optical brightener samples, as set forth below in Examples 6–17.

The results of Table II are also shown in FIG. 4. The % of retained OB (optical brightener) is indicated by the numbers. The shaded uncrosslinked composition region seems to be the useful region which is as follows:

For 5% gelatin solution greater than 10% optical brightener, based upon gel weight For 10% gelatin solution greater than 15% optical brightener based upon gel weight For 20% gelatin solution greater than 20% optical brightener based upon gel weight It is seen in FIG. 4, that at lower percent of optical brightener to gel, crosslinking took place compared to higher optical brightener to gel ratios. This is because at lower ratios, the chance of binding an optical brightener molecule to two gelatin molecules is less.

The sample of Example 9, which was not crosslinked, was stored in a refrigerator for 2 years at 40° F. after which it was heated and was found by melting stability indication that no crosslinking had taken place upon keeping. This is an advantage.

The invention has been described in detail with particular reference to preferred embodiments thereof, but it is to be understood that variations and modifications can be effected within the spirit and scope of the invention.

What is claimed is:

1. A ballasted water-soluble optical brightener of the formula:

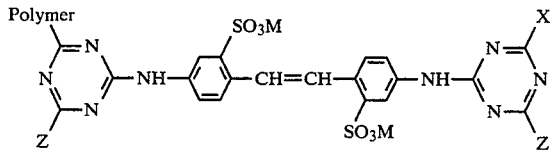

wherein Polymer is a gelatin residue; M is a cation; X is a group capable of undergoing nucleophilic displacement; and Z is

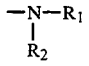

or —O—$R_3$, where each of $R_1$ and $R_2$ is a hydrogen atom, or an aromatic group which can be unsubstituted or substituted with one or more groups unreactive towards X; and R3 is an aromatic group which can be unsubstituted or substituted with one or more groups unreactive towards X.

2. An optical brightener of claim 1 wherein the optical brightener is present in an amount of about 5% to about 20% by weight, based on the weight of the gelatin.

3. A photographic element comprising in at least one layer thereof, a ballasted optical brightener according to claim 1.

4. An optical brightener which has the formula:

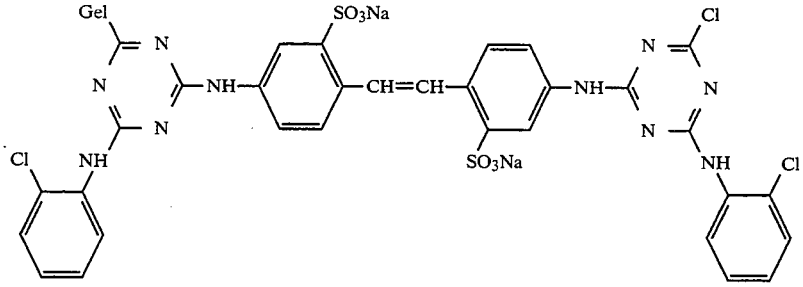

where Gel is a gelatin residue.

* * * * *